US012227957B2

(12) United States Patent
Fisher

(10) Patent No.: US 12,227,957 B2
(45) Date of Patent: Feb. 18, 2025

(54) HEADSTONE SUPPORT

(71) Applicant: David M. Fisher, Star, ID (US)

(72) Inventor: David M. Fisher, Star, ID (US)

( * ) Notice: Subject to any disclaimer, the term of this patent is extended or adjusted under 35 U.S.C. 154(b) by 0 days.

(21) Appl. No.: 17/323,865

(22) Filed: May 18, 2021

(65) Prior Publication Data

US 2021/0355702 A1 Nov. 18, 2021

Related U.S. Application Data

(60) Provisional application No. 63/026,708, filed on May 18, 2020.

(51) Int. Cl.
*E04H 13/00* (2006.01)
*E04H 12/22* (2006.01)

(52) U.S. Cl.
CPC ..... *E04H 13/003* (2013.01); *E04H 12/2269* (2013.01); *E04H 13/001* (2013.01); *E04H 13/00* (2013.01)

(58) Field of Classification Search
CPC . E04H 13/003; E04H 13/001; E04H 12/2269; E04H 13/00
See application file for complete search history.

(56) References Cited

U.S. PATENT DOCUMENTS 610,529 A 9/1898 Gilbert
3,604,172 A 9/1971 Matvey
4,175,363 A 11/1979 Moskowitz
5,623,792 A 4/1997 Crumpacker
5,845,436 A * 12/1998 Nota ..... E04H 13/003 52/103
6,336,620 B1 * 1/2002 Belli ..... E04F 11/1812 248/519
6,857,808 B1 * 2/2005 Sugimoto ..... E04H 12/2261 403/41
7,243,473 B2 * 7/2007 Terrels ..... E04C 3/32 52/843
D662,684 S * 6/2012 Edwards ..... D99/17
8,365,485 B2 * 2/2013 Reyneveld ..... E04H 12/2269 52/297

(Continued)

FOREIGN PATENT DOCUMENTS

GB 2210080 A * 6/1989 ..... E04H 13/003
JP 3727320 B2 12/2005

(Continued)

*Primary Examiner* — Omar F Hijaz
(74) *Attorney, Agent, or Firm* — Scott D. Swanson; Shaver & Swanson, LLP

(57) ABSTRACT

The invention herein relates to a headstone support. The headstone support has a base and a socket. The headstone socket is configured to receive the headstone in a tight fit so as to reduce movement and/or shifting of the headstone. The headstone socket can have at least four corners. The corners are connected by sidewalls. The sidewalls may be complete sidewalls or partial sidewalls. The base of the headstone support has flanges that extend outward from the sidewalls. The base is configured to disperse the weight of the headstone. The base may attach directly to or rest on a vault or may be placed on compacted ground. The headstone support may have openings configured for drainage. The openings may be positioned inside the socket. Alternatively, the openings may be positioned on the sidewalls.

11 Claims, 8 Drawing Sheets

(56) References Cited

U.S. PATENT DOCUMENTS

| | | | | |
|---|---|---|---|---|
| 8,429,859 | B2 | 4/2013 | Dickinson | |
| 8,561,363 | B2 | 10/2013 | DeArmond, Jr. | |
| 9,004,439 | B2 * | 4/2015 | Gross | E04H 12/2269 248/507 |
| 9,554,649 | B2 * | 1/2017 | Saich | H01Q 1/12 |
| 10,428,552 | B2 * | 10/2019 | Sinclair | E04H 17/22 |
| 2005/0214077 | A1 | 9/2005 | DeArmond | |
| 2006/0123714 | A1 | 6/2006 | Sannipoli, Sr. | |
| 2007/0235616 | A1 * | 10/2007 | Gross | E04H 12/2261 248/346.5 |
| 2009/0229195 | A1 | 9/2009 | Murphy et al. | |
| 2015/0135612 | A1 | 5/2015 | Spain | |

FOREIGN PATENT DOCUMENTS

| | | | |
|---|---|---|---|
| JP | 3802047 | B1 | 7/2006 |
| JP | 4794684 | B1 | 10/2011 |

* cited by examiner

HEADSTONE SUPPORT

TECHNICAL FIELD

The herein disclosed and claimed inventive concepts generally relate to headstone supports for use in cemeteries.

BACKGROUND

Headstones are commonly used in in cemeteries to mark graves. Headstones are typically made from a heavy material, including stone such as granite and marble or metal such as iron or bronze. Due to the weight of the headstones, the headstones regularly shift and sink into the ground due to gravity, forces of nature, or the ground giving way when the coffin collapses.

Large cemeteries, such as Veteran Memorial Cemeteries, have thousands of headstones. The standard headstone used by the Department of Veterans Affairs (VA) is four inches wide by thirteen inches long and weighs approximately 230 pounds. The dimensions of the standard headstone result in 4.3 pounds per square inch ("PSI") being applied downward into the ground. This can lead to significant sinking and/or shifting of the headstone. Thus, a significant amount of time and resources can be spent repositioning headstones in large cemeteries.

In light of the foregoing, there is a need for a device that reduces the amount of shifting and sinking of headstones. What is further needed is a device that is capable of resting on vaults or compacted ground in order to disperse the amount of pressure applied per square inch to the coffin or vault.

SUMMARY OF THE DISCLOSURE

The purpose of the Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the inventive concept(s) of the application, which is measured by the claims, nor is it intended to be limiting as to the scope of the inventive concept(s) in any way.

In accordance with the present invention is a new and improved headstone support for use in cemeteries. The headstone support is configured to reduce sinking and shifting movement of a headstone after installation. The headstone support includes a headstone socket extending from a base. The headstone socket is configured to receive and secure a headstone by being close fitting to the headstone. In a preferred embodiment, the headstone socket has the shape of the headstone. For standard military headstones, the socket has four side walls extending between four corners and configured to receive and secure a headstone. Alternatively the socket can have four corners with incomplete walls stretching between the corners. The dimensions of the headstone socket are configured to fit the dimensions of the headstone to be supported.

In a preferred embodiment, the headstone socket is configured to receive a headstone that is four inches (4") wide and thirteen inches (13") long. The headstone socket is preferably ten inches (10") deep to accommodate a standard military issue headstone. In alternate embodiments, the headstone socket size may vary depending on the size and weight of the desired headstone.

The base is configured to be positioned underground, either on top of the vault or compacted ground to disperse the downward pressure caused by the weight of the headstone. The base can be configured with a flat underside in order to rest on a flat portion of the vault. The base is configured to be positioned on top of compacted ground. Alternatively, the base can be configured to be attached to the top of a burial vault. The base may be configured to have bolt openings that serve to attach the headstone support to the top of a burial vault. The base serves to disperse the weight of the headstone through one or more flanges that extend away from the socket. The flange can be a uniform flange extending from the base. Alternatively, the flange can be in multiple segments or formed as multiple flanges. The base is preferably ten inches (10") wide by twenty inches (20") long to disperse the weight of a standard military headstone. The size of the base can vary depending on size of headstone and depending on the amount of movement reduction that is required (i.e. if the headstone is used in a climate with regularly harsh weather).

In one embodiment, the base is configured to attach to the top of a burial vault. In this embodiment, the base defines bolt openings. Alternatively, the base can attach by any other attachment constructions known in the art. Alternatively, the base is configured to be positioned under the ground surface or on top of the ground surface.

Preferably the base has an opening formed within the perimeter of the socket. The opening is configured to allow for liquid drainage of any liquid that has entered the socket. Alternatively, one or more openings can be positioned in a lower portion of a sidewall of the socket to allow for drainage of liquid within the socket.

The headstone support is preferably constructed of molded plastic. In alternative embodiments, the headstone support can be made from stone, metal or metal alloys, wood, or any other polymer capable of supporting a headstone.

One of the objects of this invention is to reduce the need for realignment of the headstone once the headstone is installed. This will reduce the amount of man-hours spent to constantly realign headstones and therefore saving cemeteries or the VA a significant amount of money. The desired aesthetics of the headstones maintaining their desired alignment will be achieved by using the headstone support.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE EXEMPLARY EMBODIMENTS

Figure 1:
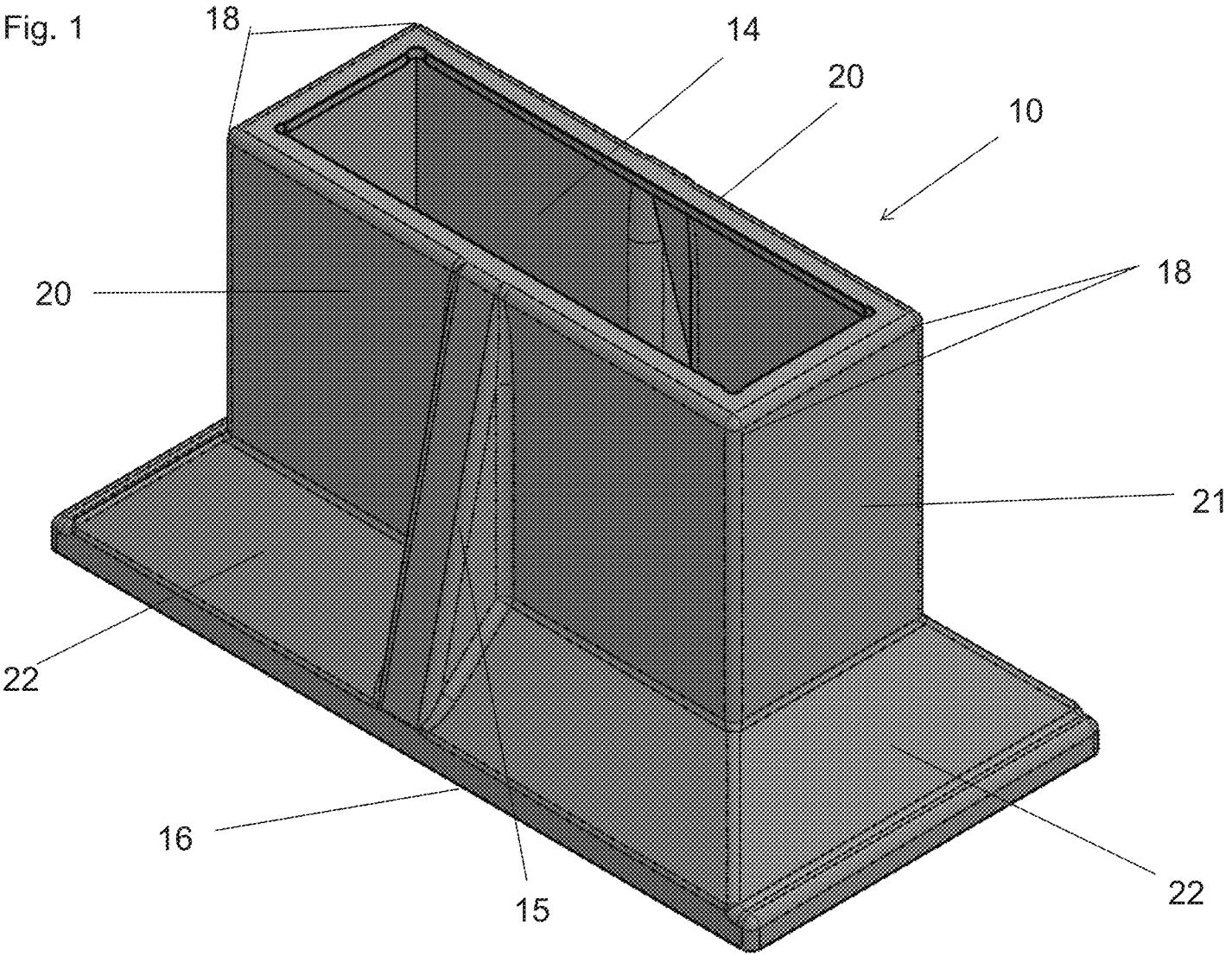
FIG. 1 illustrates a perspective side view of an embodiment of a headstone support.
Figure 2:
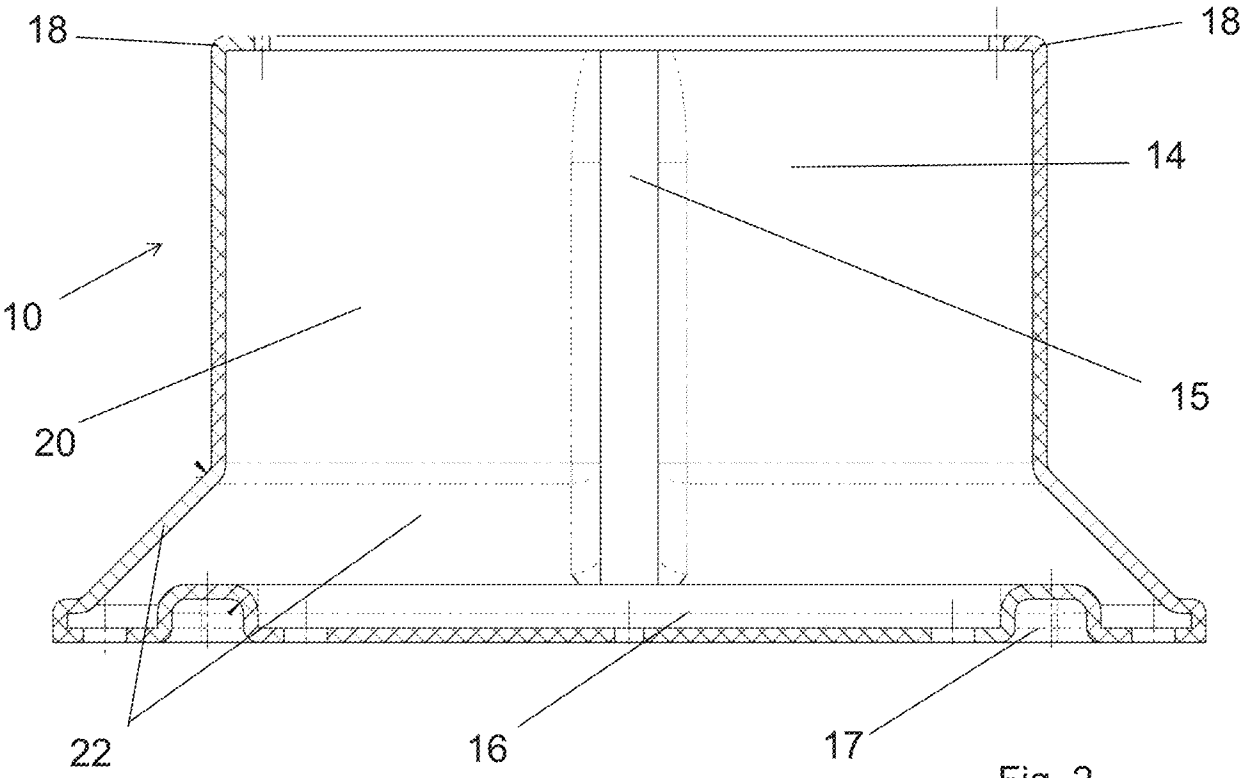
FIG. 2 illustrates a side view of the headstone support in FIG. 1.
Figure 3:
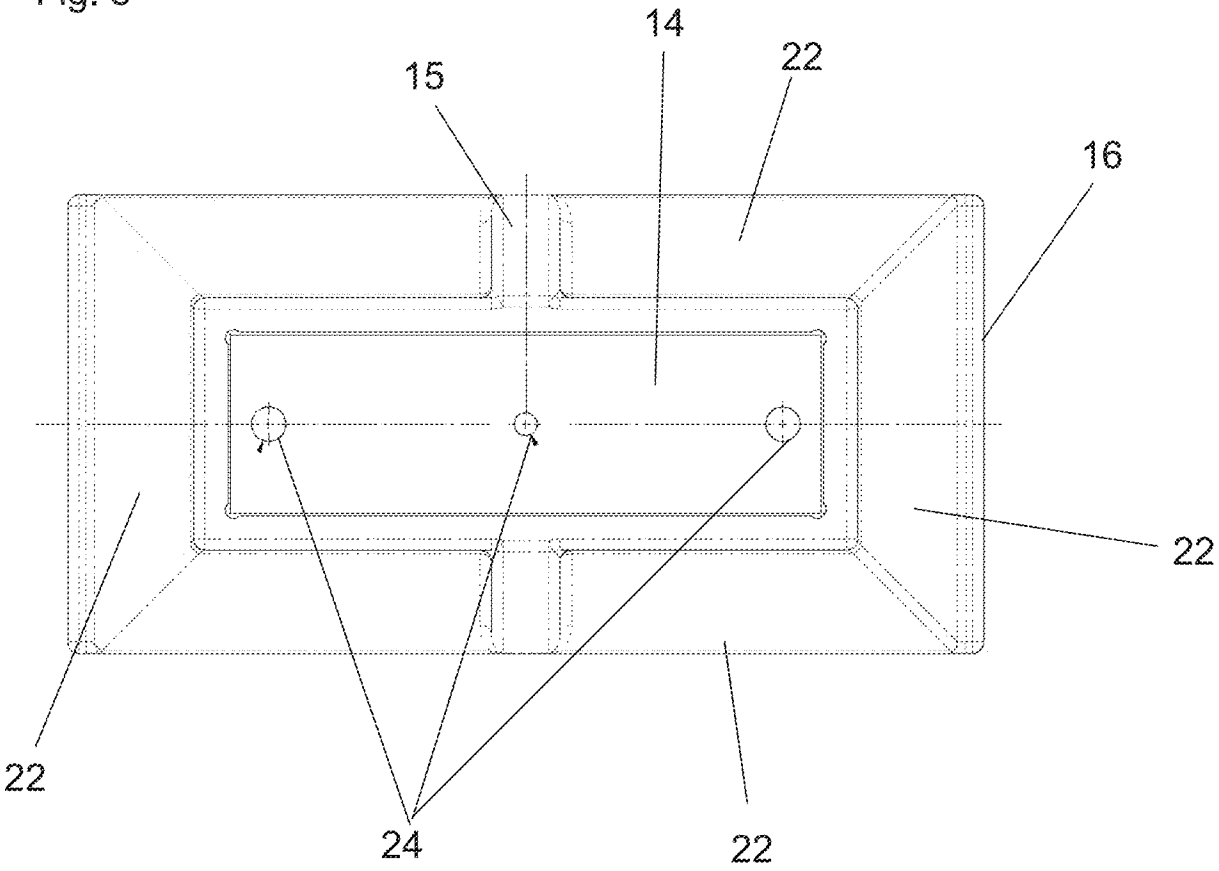
FIG. 3 illustrates a top down perspective view of the headstone support in FIG. 1.
Figure 4:
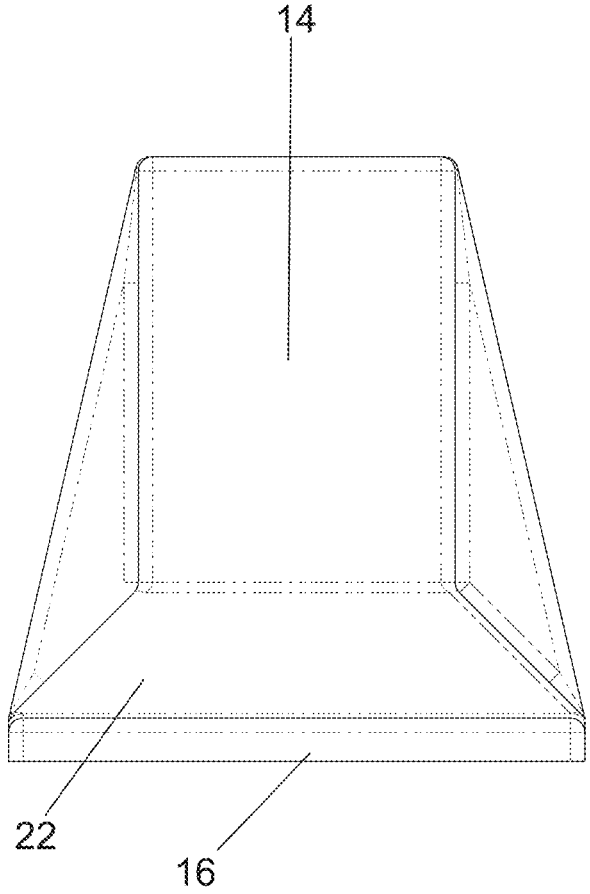
FIG. 4 illustrates a transected side view of the headstone support in FIG. 1.
Figure 5:
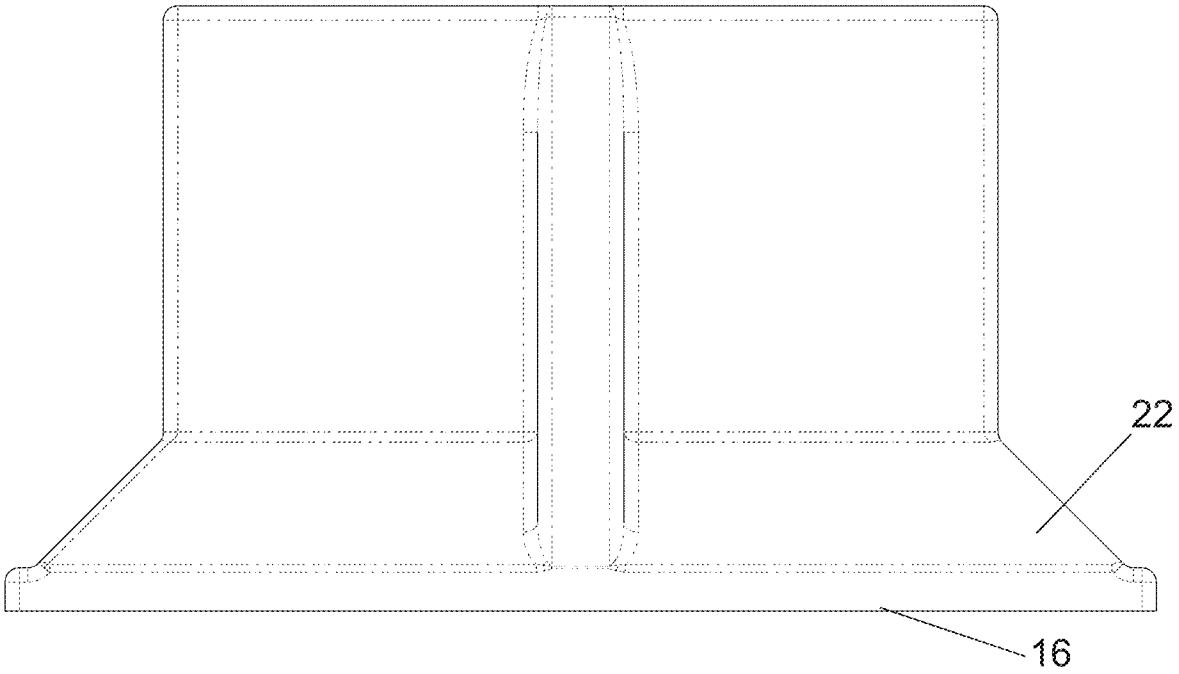
FIG. 5 illustrates a transected side perspective view of the headstone support in FIG. 1.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

The phrases "in one embodiment," "in various embodiments," "in some embodiments," and the like are used repeatedly. Such phrases do not necessarily refer to the same embodiment. The terms "comprising," "having," and "including" are synonymous, unless the context dictates otherwise. Such terms do not generally signify a closed list.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternate embodiments, additional devices, or combinations of illustrated devices, may be added to, or combined, without limiting the scope to the embodiments disclosed herein.

FIGS. 1-5 illustrate a one embodiment of a headstone support 10 configured to support a headstone (not depicted). In this embodiment, the headstone support includes a headstone socket 14 and a base 16. The headstone socket 14 is configured to be positioned on top of a vault after the vault has been positioned in an open grave. Alternatively the headstone socket 14 can be configured to attach to the vault by adhesive or other attachment constructions known in the art. In alternate embodiments, the headstone support is a single molded piece.

The headstone socket 14 is defined by four corners 18 having four side walls 20, 21 extending between the corners. The headstone support also includes a stabilizing fin 15. The stabilizing fin 15 is preferably positioned in the center of the side walls 20. Alternatively, the side walls can be formed as incomplete or partial walls between the corners. The socket 14 is configured to receive and secure the headstone in a tight fit such that the headstone cannot move within the socket. In an alternate embodiments, the headstone socket has more than four side walls or the headstone socket has at least four corner supports configured to secure the headstone. Alternative shapes can be utilized for alternative shaped headstones. In these alternate embodiments, the dimensions of the socket are configured to fit the dimensions of the headstone.

In a one embodiment, the headstone socket 14 is ten inches (10") deep and configured to receive a headstone that is four inches (4") wide by thirteen inches (13") long. The dimensions of the socket may vary depending on the size and weight of the desired headstone.

The base 16 is configured to expand the footprint of the headstone and allow for dispersion of the pressure on the vault from the weight of the headstone. The base 16 has flanges 22 that extend in an outward direction from the socket 14. The base 16 may have bolt openings 17 configured to attach the headstone support to a burial vault. Alternative attachment means may also accomplish the attachment of the base to a burial vault. In a one embodiment, the base is ten inches (10") wide by twenty inches (20") long. The size of the base may vary depending on the size and weight of the headstone and/or the conditions in which the headstone support 10 is utilized.

The base 16 has a plurality of openings 24 located within the perimeter of the socket 14. The openings 24 are configured to allow drainage of liquids from within the socket 14. Alternatively, a lower portion of the sidewalls 22 have a plurality of openings configured to allow for drainage of a liquid from within the socket 14.

In a preferred embodiment, for military headstones, the base 16 is generally planar with a rectangular socket 14 extending from the base. The flanges 22 extend in a generally planar direction outward from the socket 14. In alternate embodiments, the base is curved to engage with the curved surface of a casket or vault.

In an alternate embodiment, the base 16 has a plurality of openings 24 for bolts and the base is configured to attach to the vault or casket. In other embodiments, the base is configured to attach to the vault or casket by other attachment constructions known in the art.

Figure 6:
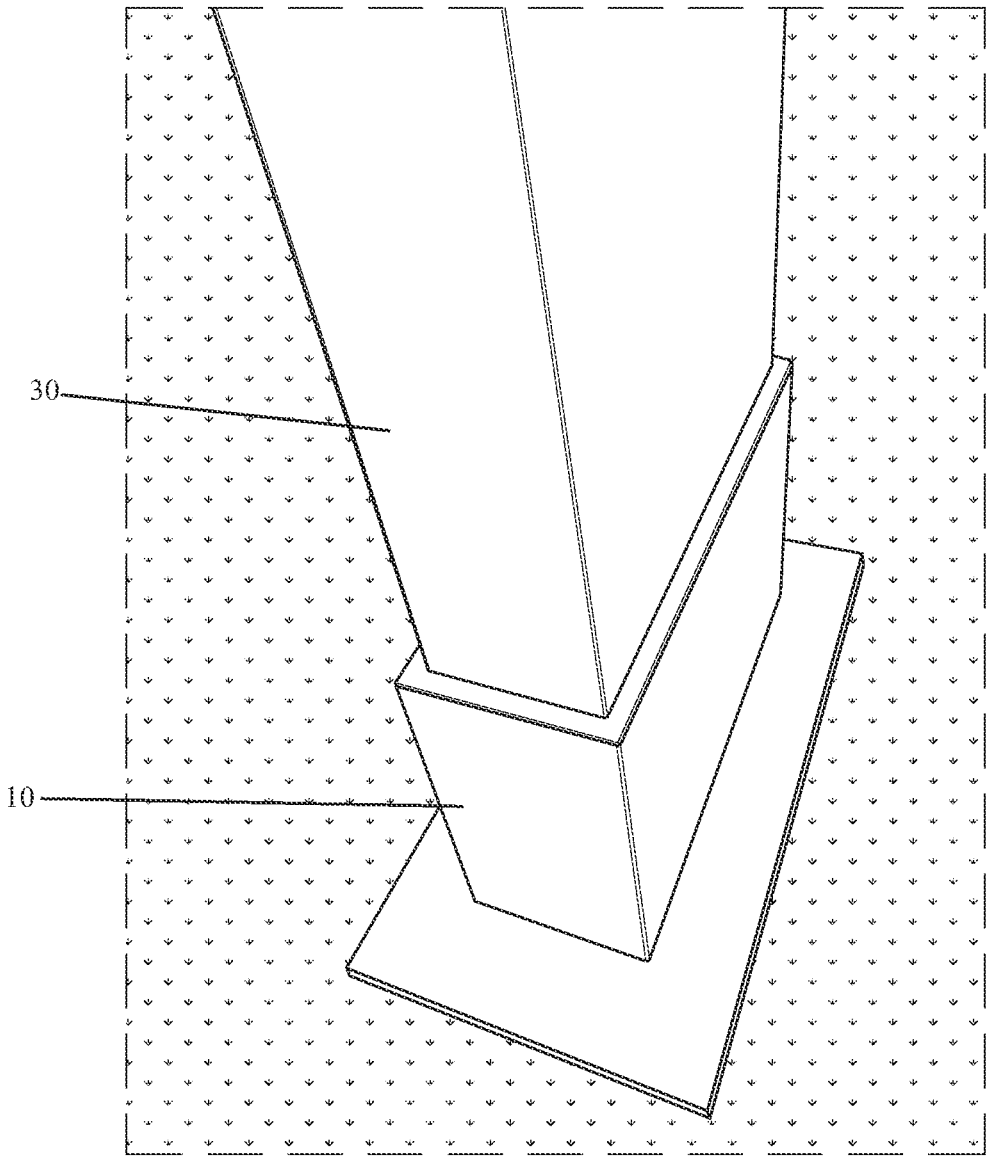
FIG. 6 illustrates a perspective side view of a headstone positioned within a headstone support.
Figure 7:
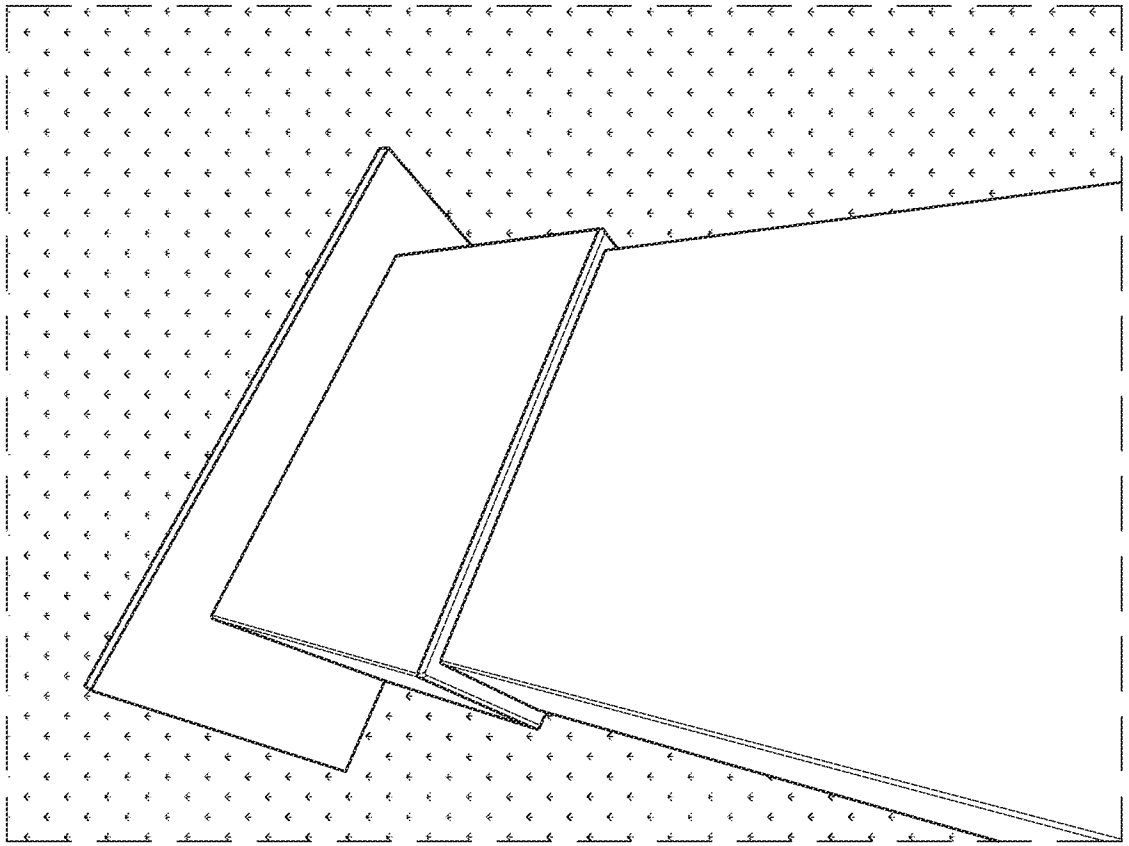
FIG. 7 illustrates a perspective front view of the headstone positioned within the headstone support of FIG. 6.

FIGS. 6 and 7 illustrate a headstone 30 positioned within the socket of the headstone support. The headstone support is configured for the specific headstone size, with the headstone tightly fitting within the socket of the headstone base.

Figure 8:
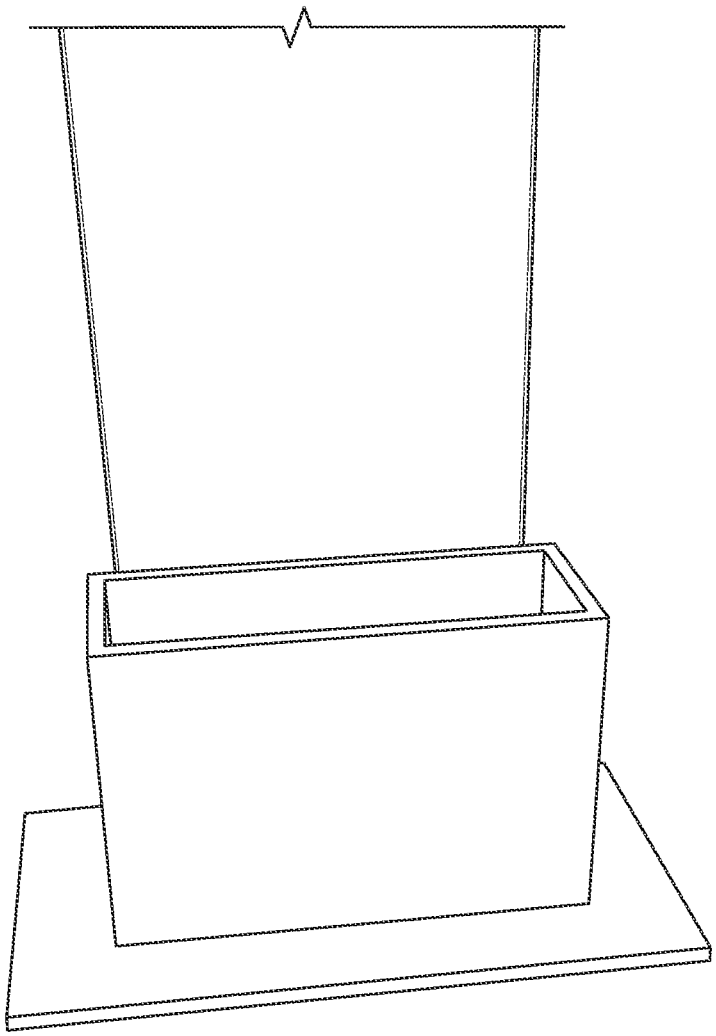
FIG. 8 illustrates a perspective front view of the headstone of FIGS. 6 and 7 positioned behind the headstone support.

FIG. 8 illustrates the headstone positioned behind the headstone support for reference. The headstone socket is configured of the same width and depth of the headstone in order to prevent the headstone from moving or wobbling when in the base.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

The features described with respect to one embodiment may be applied to other embodiments or combined with or interchanged with the features of other embodiments, as appropriate, without departing from the scope of the present invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

While certain exemplary embodiments are shown in the figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

What is claimed is:

1. A headstone and headstone support combination, the headstone being inserted into the headstone support, the combination comprising:

a headstone support comprising a headstone socket and a base integrally formed as a single molded apparatus, wherein said headstone socket is configured to receive the headstone such that the headstone does not move and the headstone is supported on said base, said headstone socket extending away from said base to an opening of said headstone socket at a first end of said headstone socket;

wherein said headstone socket comprises at least four corners, wherein said corners are connected by said sidewalls, said headstone socket defining a width and a length with the length being longer than the width;

wherein the headstone is positioned within said headstone socket, said headstone support retaining said headstone in an upright position; and wherein said base comprises a flange at a second end of said headstone socket and extending perpendicular to said sidewalls of said headstone socket away from a center of said headstone socket, said flange extending away from said second end of said headstone socket such that said headstone extends upward out of said headstone socket opening at said first end of said headstone socket, wherein said flange of said base is configured to disperse the weight of said headstone positioned within said headstone socket, wherein said headstone support comprising a fin extending from an outer surface of said socket along said length of said socket to said flange, said fin being integrally molded to said flange and said socket.

2. The headstone and headstone support of claim 1, wherein said headstone socket and said base are comprised of plastic.

3. The headstone and headstone support of claim 1, wherein said headstone is four inches wide and thirteen inches long.

4. The headstone and headstone support of claim 1, wherein said base is configured to attach to a casket.

5. The headstone and headstone support of claim 1, wherein said sidewalls of said headstone socket are complete sidewalls.

6. The headstone and headstone support of claim 1, wherein said sidewalls of said headstone socket are partially completed sidewalls.

7. The headstone and headstone support of claim 1, wherein said base comprises an opening configured to allow for drainage.

8. The headstone and headstone support of claim 1, wherein said base is ten inches wide by twenty inches long.

9. The headstone and headstone support of claim 1, wherein said headstone is a military headstone.

10. The headstone and headstone support of claim 1, wherein said headstone socket is four inches wide by thirteen inches long.

11. The headstone and headstone support of claim 1, wherein said flange extends in a generally planar direction outward from said socket.

* * * * *